United States Patent [19]

Abel et al.

[11] 3,930,864

[45] Jan. 6, 1976

[54] AUXILIARY MORDANT LAYER FOR EXCESS DYE FORMED IN INTEGRAL COLOR TRANSFER ASSEMBLAGE

[75] Inventors: Edward P. Abel; Richard W. Becker, both of Rochester, N.Y.

[73] Assignee: Eastman Kodak Company, Rochester, N.Y.

[22] Filed: Apr. 15, 1974

[21] Appl. No.: 461,031

[52] U.S. Cl. ..... 96/77; 96/3; 96/29 D

[51] Int. Cl.[2] ... G03C 1/40; G03C 7/00; G03C 5/54

[58] Field of Search..... 96/3, 29 D, 77

[56] References Cited

UNITED STATES PATENTS

| | | | |
|---|---|---|---|
| 2,977,226 | 3/1961 | Land | 96/3 |
| 3,620,731 | 11/1971 | Pelsach | 96/3 |
| 3,647,437 | 3/1972 | Land | 96/3 |
| 3,679,409 | 7/1972 | Buckler et al. | 96/77 |
| 3,721,556 | 3/1973 | Fix | 96/77 |
| 3,836,365 | 9/1974 | Reid | 96/3 |

*Primary Examiner*—David Klein
*Assistant Examiner*—Richard L. Schilling
*Attorney, Agent, or Firm*—H. E. Cole

[57] ABSTRACT

Excessive image density produced during or after processing by dye diffusing from the image generating unit into the dye image-receiving layer of an integral color transfer assemblage is controlled by incorporating into the assemblage a scavenger layer capable of immobilizing byproducts of processing reactions which may affect image quality in the image-receiving layer.

28 Claims, 4 Drawing Figures

Figure 2:
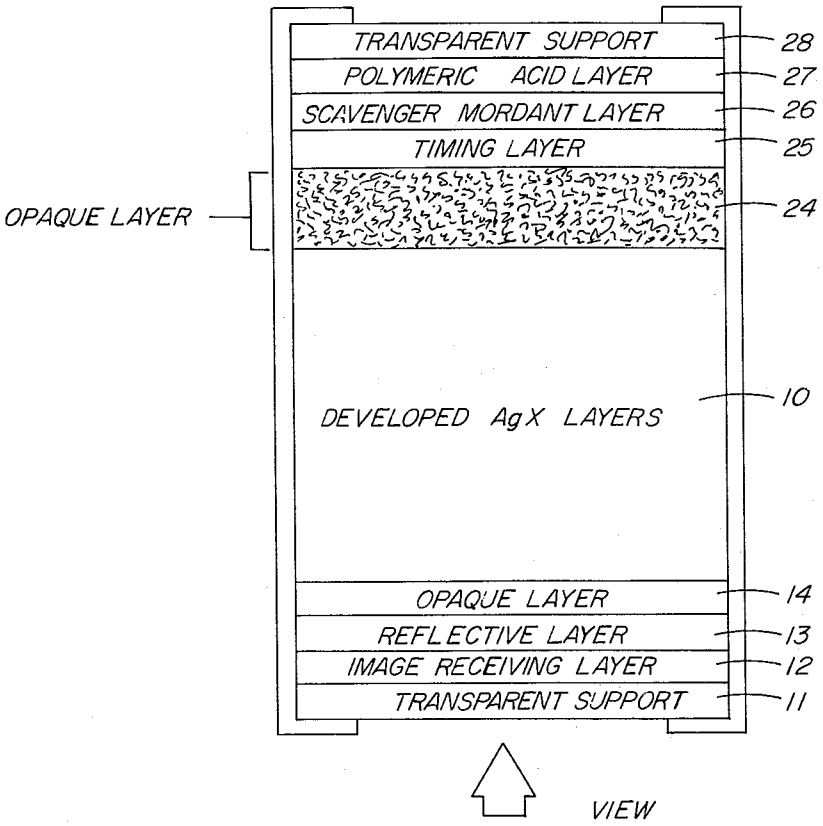

AUXILIARY MORDANT LAYER FOR EXCESS DYE FORMED IN INTEGRAL COLOR TRANSFER ASSEMBLAGE

This invention relates to photography and more particularly to color photography for integral color diffusion transfer assemblages wherein excess image density is controlled and byproducts of the processing reactions are rendered immobile.

Various formats for color diffusion transfer assemblages are described in the prior art such as U.S. Pat. Nos. 3,415,644; 3,415,645; 3,415,646; 3,647,437; 3,635,707 and Canadian Pat. Nos. 928,559 and 674,082. In these formats, the image-receiving layer containing the photographic image for viewing can remain permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject. A pH-lowering layer is generally employed in these assemblages to stabilize the element after the required diffusion of dyes has taken place. A timing layer is generally employed in conjunction with the pH-lowering layer so that the pH is not prematurely lowered which would stop development. The development time is thus established by the time it takes the alkali to penetrate through the timing layer. As the system starts to become stabilized, alkali is depleted throughout the structure causing silver halide development to cease in response to this drop in pH. For each image generating unit, this shutoff mechanism can establish the amount of silver halide development and the related amount of dye formed according to the respective exposure values.

To obtain an optimum level of dye in the image-receiving layer for good photographic performance, excess dye is often generated in the image-recording layers. However, a practical requirement for the formats described above consists in image formation in an acceptably short time. After a satisfactory image has been formed, it is desirable that it remain substantially unchanged indefinitely thereafter. Since the image consists of dyes which have diffused to and have been immobilized by the dye image-receiving layer, it is necessary that the dye flux into the image-receiving layer from the image generating layers be terminated after dye levels have reached values which define an acceptable image. While diminishing alkalinity in the image-forming layers produced by the neutralization of alkaline processing fluid provides an effective shutoff mechanism for silver halide development and related dye formation, the change in pH does not always result in immobilization of dyes already formed in amounts which may exceed the requirements for acceptable image quality and which are present in the swollen structure. In the absence of means for immobilizing excess dyes in layers other than the dye image-receiving layer, these excess amounts of dye can slowly diffuse to the dye image-receiving layer, causing progressive changes in image quality upon process termination. Among the changes in image quality are objectionable buildup of density in shadow areas and changes in color balance attributable to differences in rates of diffusion of the separate dyes within the structure.

U.S. Pat. No. 3,679,409 relates to inhibiting the diffusion of undesirable image-forming materials to the image receiving element of a multicolor diffusion transfer product by forming in such product in situ an image-forming material impermeable layer between the image receiving element and the next adjacent silver halide emulsion layer, subsequent to substantial image formation. In practice, however, the in situ formation of a polymeric barrier layer after image formation has taken place is difficult to contol. The time required for processing composition solvent to decrease to a point so that the polymeric layer may coalesce to provide the barrier stratum may be in excess of the desired development time. Polymers with the required pH-dependent permeabilities and which would not otherwise interfere with image formation are difficult to find. In addition, controlling a cross-linking reaction during the processing of a diffusion transfer assemblage, taking into account such variables as temperature would also be difficult to control in actual practice.

In still other image transfer processes, by-products of the processing reaction could be immobilized by employing materials such as the resorcinol scavengers as disclosed in Gates et al. U.S. Pat. No. 3,770,431, Sculard U.S. Pat. No. 3,772,014 and the like, which react with excess or unwanted reaction products. Materials of this type could be used advantageously when excess oxidized color developers are to be immobilized to prevent contamination of the image record. However, these materials are somewhat limited in their effectiveness when less reactive reaction products are to be scavenged.

It is an object of this invention to provide a means for effective immobilization of those amounts of dyes produced in image-forming layers in excess of requirements for acceptable amounts of dyes required for a dye image-receiving layer of an integral color diffusion transfer assemblage.

It is another object of this invention to scavenge unwanted by-products of the processing reaction.

It is still another object of this invention to provide a scavenger mordant layer for excess dye density control in an integral color diffusion transfer assemblage which may be exposed and viewed from the same or opposite sides.

It is still another object of this invention to reduce the excess dye density in the dye image-receiving layer of an integral color diffusion transfer assemblage which is processed at higher than normal processing temperatures.

These and other objects of our invention are achieved by a photographic assemblage comprising:

a. a support having thereon at least one photosensitive silver halide emulsion layer, the emulsion layer having associated therewith a dye image-providing material;

b. a dye image-receiving layer; and c. means for discharging an alkaline processing composition within the assemblage, the assemblage containing a silver halide developing agent, wherein a scavenger mordant layer is employed in the assemblage to scavenge excess dye and unwanted by-products produced during processing of the assemblage, the scavenger mordant layer being so located in the assemblage that when the alkaline processing composition is discharged within the assemblage, the scavenger mordant layer will be on one side of both the alkaline processing composition layer and the emulsion layer and the dye image-receiving layer will be on the other side of these layers, and wherein the scavenger mordant layer is located in a timing layer or behind a timing layer with respect to the silver halide emulsion layer.

Figure 1:
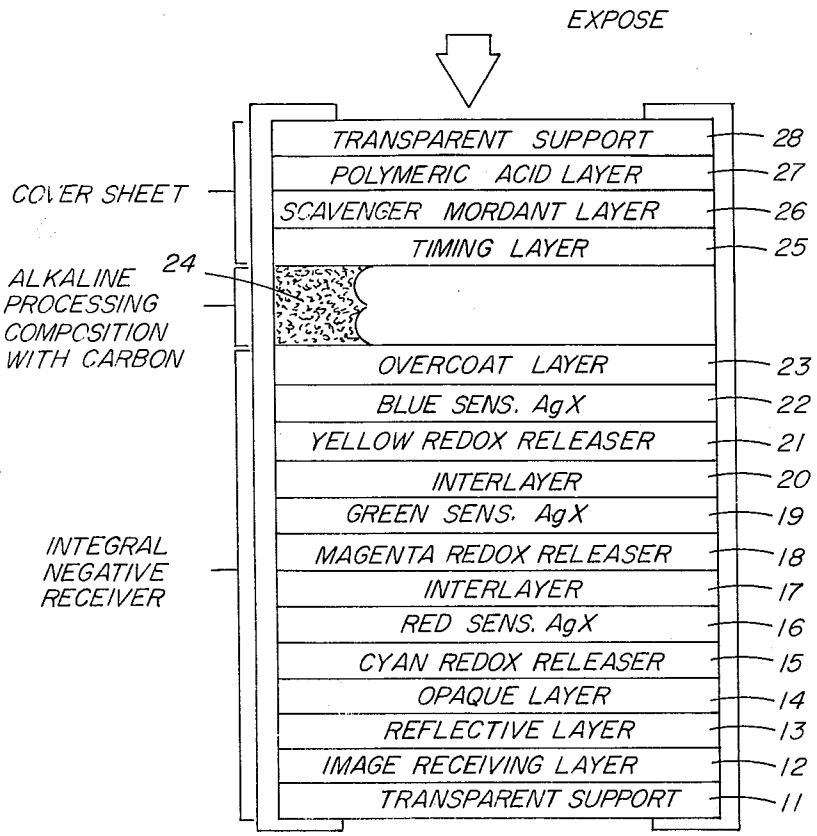

FIG. 1 of the drawings is a cross-section of a color diffusion transfer assemblage before processing wherein the scavenger mordant layer is on the cover sheet.

FIG. 2 is the assemblage of FIG. 1 after processing. The transfer image in FIG. 2 is viewed from the opposite side of the exposure in FIG. 1.

Figure 3:
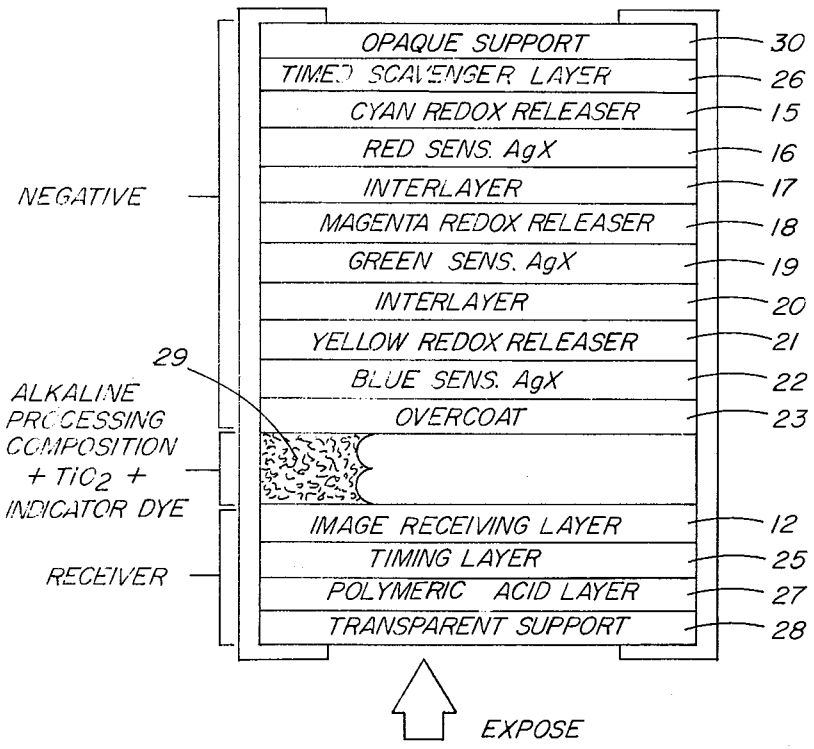

FIG. 3 of the drawings is a cross-section of a color diffusion transfer assemblage before processing. The scavenger mordant layer in this format is adjacent the support of the negative element.

Figure 4:
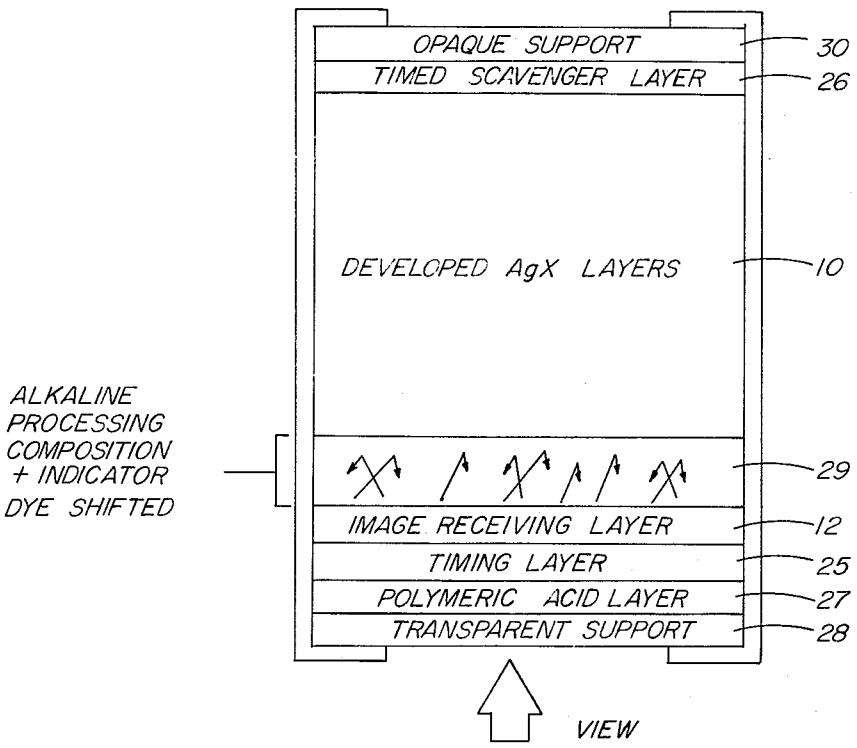

FIG. 4 is the assemblage of FIG. 3 after processing. The transfer image in FIG. 4 is viewed from the same side of the exposure in FIG. 3.

A useful format for integral negative-receiver color diffusion transfer assemblages in which the present invention can be employed is disclosed in Canadian Pat. No. 928,559. This is illustrated in FIGS. 1 and 2. In this embodiment, the support 11 for the photosensitive element is transparent and is coated with the image-receiving layer 12, a light-reflective layer 13, an opaque layer 14, and photosensitive layers 16, 19 and 22, having associated therewith dye image-providing material layers 15, 18 and 21 along with interlayers 17 and 20 and overcoat layer 23. A rupturable container containing an alkaline processing composition and an opacifier such as carbon black 24 is positioned adjacent to the top layer and a transparent cover sheet. The cover sheet comprises a transparent support 28 which is coated with a polymeric acid layer 27, and scavenger mordant layer 26 and a timing layer 25. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the assemblage 10 to protect it from exposure as shown in FIG. 2. The processing composition dvelops each silver halide layer and dye images are formed as a result of development which diffuse to the image-receiving layer to provide a right-reading image which is viewed through the transparent support on the opaque reflecting layer background. Excess diffusible dye which may be present in the assemblage is immobilized in the scavenger mordant layer. In this embodiment, the scavenger mordant layer is located behind a timing layer with respect to the emulsion layer, although it could be admixed as well with the timing layer in a separate timed scavenger layer. For further details concerning the format of this particular integral assemblage, reference is made to the above-mentioned Canadian Pat. No. 928,559.

Another useful format for integral color diffusion transfer assemblages in which the present invention can be employed is described in U.S. Pat. No. 3,415,644. This is illlustrated in FIGS. 3 and 4. In this embodiment, the negative comprises an opaque support 30 which is coated with a timed, scavenger mordant layer 26 and photosensitive layers 16, 19 and 22 having associated therewith dye image-providing material layers 15, 18 and 21 along with interlayers 17 and 20 overcoat layer 23. A rupturable container containing an alkaline processing composition and $TiO_2$ and an indicator dye 29 is positioned adjacent to the top layer and a transparent receiver. The receiver comprises a transparent support 28 which is coated with a polymeric acid layer 27, a timing layer 25 and an image-receiving layer 12. The film unit is placed in a camera, exposed through the transparent receiver and then passed through a pair of pressure-applying members in the camera as it is being removed therefrom. The pressure-applying members rupture the container and spread processing composition, $TiO_2$ and indicator dye over the image-forming portion of the assemblage 10 to protect it from exposure as shown in FIG. 4. The processing composition develops each silver halide layer and dye images are formed as a result of development which diffuse to the image-receiving layer which is viewed through the transparent support on a white background--the indicator dye having "shifted" to a colorless form as the alkali is consumed by the polymeric acid layer. A substantial portion of the excess dye which may be formed in the assemblage can be immobilized in the timed, scavenger mordant layer. In this embodiment, the scavenger mordant material and timing layer material are present together in a single timed scavenger layer, although they could be in separate layers as in FIGS. 1 and 2 if desired. For further details concerning the format of this particular assemblage, reference is made to the above-mentioned U.S. Pat. No. 3,415,644. Indicator dyes useful in this format are known in the art as illustrated, for example, by U.S. Pat. No. 3,647,437, the disclosure of which is hereby incorporated by reference. Phthalein dyes are preferred. Since the image in this embodiment is geometrically reversed, an image-reversing optical system such as a mirror in the camera is needed to reverse the image so that a right-reading image is viewable in the dye image-releiving layer.

Still other useful integral formats in which our invention can be employed are described in U.S. Pat. Nos. 3,415,645; 3,415,646; 3,647,437; 3,635,707; and British Pat. No. 1,330,524.

The photosensitive element in our invention can be treated with an alkaline processing composition to effect or initiate development in any manner. A preferred method for applying processing composition is by use of a rupturable container or pod which contains the composition. In general, the processing composition employed in our system contains the developing agent for development, although the composition could also just be an alkaline solution where the developer is incorporated in the photosensitive element, in which case the alkaline solution serves to activate the incorporated developer.

The dye image-providing materials which may be employed in our invention generally may be characterized as either (1) initially soluble or diffusible in the processing composition but are selectively rendered nondiffusible in an imagewise pattern as a function of development; or (2) initially insoluble or nondiffusible in the processing composition but which are selectively rendered diffusible in an imagewise pattern as a function of development. These materials may be preformed dyes or dye precursors, e.g., color couplers, oxichromic compounds and the like.

Examples of initially soluble or diffusible materials which may be employed in our invention are disclosed, for example, in U.S. Pat. Nos. 2,647,049; 2,661,293; 2,698,244; 2,698,798; 2,802,735; 2,774,668; and 2,983,606. Examples of initially nondiffusible materials which may be employed in our invention are disclosed in U.S. Pat. Nos. 3,227,550; 3,227,551; 3,227,552; 3,227,554; 3,243,294; and 3,445,228.

In a preferred embodiment of our invention the dye image-providing material is a nondiffusible redox dye releaser. Such compounds are, generally speaking, compounds which can be oxidized by oxidized developing agent, i.e., cross-oxidized, to provide a species which as a function of oxidation will release a diffusible dye, such as by alkaline hydrolysis. Such redox dye releasers are described in U.S. Pat. 3,725,062 of Anderson and Lum, issued Apr. 3, 1973; U.S. Pat. No. 3,698,897 of Gompf and Lum, issued Oct. 17, 1972; U.S. Pat. No. 3,628,952 of Puschel et al., issued Dec. 21, 1971; U.S. Pat. No. 3,443,939 of Bloom et al., issued May 13, 1969; U.S. Pat. No. 3,443,940 of Bloom et al., issued May 13, 1969; and the following copending applications: Ser. Nos. 351,673 of Fleckenstein et al., and 351,700 of Fleckenstein, filed Apr. 16, 1973; Ser. Nos. 331,727 and 331,729 of Landholm et al. filed Feb. 12, 1973 both now abandoned; Ser. No. 331,728 of Haase et al. filed Feb. 12, 1973 and now abandoned; and Ser. No. 326,628 of Hinshaw et al. filed Jan. 26, 1973 and now abandoned, the disclosures of which are hereby incorporated by reference.

In an especially preferred embodiment of our invention, the redox dye releasers in the Fleckenstein et al. application Ser. No. 351,673 referred to above are employed. Such compounds are nondiffusible sulfonamido compounds which are alkali-cleavable upon oxidation to release a diffusible dye from the benzene nucleus and have the formula:

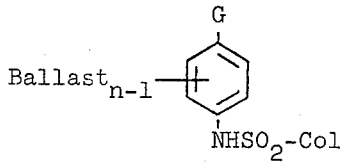

wherein:

1. Col is a dye or dye precursor moiety:
2. Ballast is an organic ballasting radical of such molecular size and configuration (e.g., simple organic groups or polymeric groups) as to render the compound nondiffusible during development in an alkaline processing composition;
3. G is OR or NHR$_1$ wherein R is hydrogen or a hydrolyzable moiety and R$_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when R$_1$ is an alkyl group of greater than 6 carbon atoms, it can serve as a partial or sole Ballast group); and
4. *n* is a positive integer of 1 to 2 and is 2 when G is OR or when R$_1$ is hydrogen or an alkyl group of less than 8 carbon atoms.

For further details concerning the above-described sulfonamido compounds and specific examples of same, reference is made to the above-mentioned Fleckenstein et al. application Ser. No. 351,673 and Belgian Pat. 788,268, issued Feb. 28, 1972, the disclosures of which are hereby incorporated by reference.

Sulfonamido compounds which can be employed in our invention include the following:

Compound No. 1

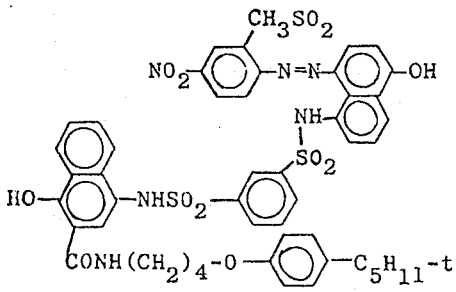

Compound No. 2

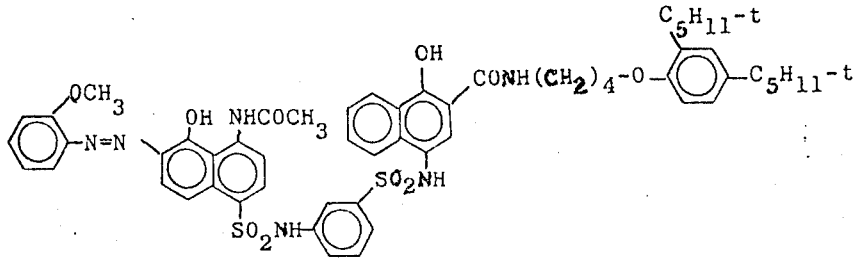

Compound No. 3

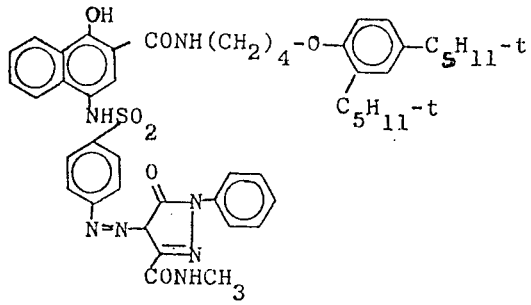

Compound No. 4

3-Pentadecyl-4-(p-phenylazobenzenesulfonamido)-phenol

Compound No. 5

1-Hydroxy-4-(p-phenylazobenzenesulfonamido)-2-[Δ-(2,4-di-tert-amylphenoxy)-n-butyl]-naphthamide Compound No. 6

8-Acetamido-3,6-disulfo-2- p-[(4-hydroxy-2-pentadecyl)-benzenesulfonamido]-phenylazo -naphthol monopyridinium salt Compound 7

2- p-[(4-Hydroxy-2-pentadecyl)-benzenesulfonamido]-phenylazo -4-isopropoxynaphthol Compound No. 8

4- p-[4'-(N,N-Dimethylamino)-phenylazo]-benzenesulfonamido -3-pentadecylphenol

Compound No. 9

1-Hydroxy-4-[4-(1-hydroxy-4-isopropoxy-2-naphthylazo)-benzenesulfonamido]-2-[Δ-(2,4-di-tert-amylphenoxy)-n-butyl]-naphthamide Compound No. 10

1-Hydroxy-4-[3-(1-phenyl-3-methylcarbamyl-4-pyrazolin-5-onylazo)-benzenesulfonamido]-2-[Δ-(2,4-di-tert-amylphenoxy)-n-butyl]-naphthamide Compound No. 11

4-[p-(4'-Dimethylaminophenylazo)-benzene-sulfonamido]-N-n-dodecylaniline

Compound No. 12

3-Pentadecyl-4-(p-phenylazobenzenesulfonamido)-aniline

Compound No. 13

1-(N-n-Dodecylamino)-4-(p-phenylazobenzenesulfonamido)-naphthalene

Compound No. 14

2- p-[(4-amino-2-pentadecyl)-benzene-sulfamyl]-phenylazo -4-isopropoxynaphthol

Compound No. 15

4- p-[4'-(N',N'-dimethylamino)-phenylazo]-benzenesulfonamido -3-octyl-N-ethylaniline Compound No. 16

5- p-[4'-(N,N-Dimethylamino)-phenylazo]-benzenesulfonamido -8-(N'-n-dodecylamino)-quinoline Compound No. 17

Shifted Magenta Dye-providing

1-Hydroxy-4-[3-(N-[4-(3,5-dibromo-4-hydroxyphenylimino)-1-phenyl 2-pyrazolin-5-on-3-yl]carbamyl)-benzenesulfonamido]-2-[Δ-(2,4-di tert-amylphenoxy)-n-butyl]naphthamide Compound No. 18

Cyan Dye-Providing (Initially Leuco)

1-Hydroxy-4-[3-(4-[3-chloro-5-(3,5-dichloro-4-hydroxyanilino)-2-hydroxy-4-methylanilino]-6-hydroxy-s-triazinyl-2amino)-benzenesulfonamido]-2-[Δ-(2,4-di-tert-amylphenoxy)-n-butyl]-naphthamide In another preferred embodiment of our invention, initially diffusible dye image-providing materials are employed such as dye developers, including metal complexed dye developers such as those described in U.S. Pat. Nos. 3,453,107, 3,544,545; 3,551,406; 3,563,739; 3,597,200; 3,705,184: and oxichromic developers as described and claimed in our coworkers, Lestina and Bush, Application Ser. No. 401,327, filed Sept. 27, 1973, the disclosures of which are hereby incorporated by reference. When oxichromic developers are employed, the image is formed by the diffusion of the oxichromic developer to the dye image-receiving layer where it undergoes chromogenic oxidation to form an image dye. Examples of such oxichromic developers which provide indophenol dyes and which may be employed in our invention include the following:

Compound No. 19

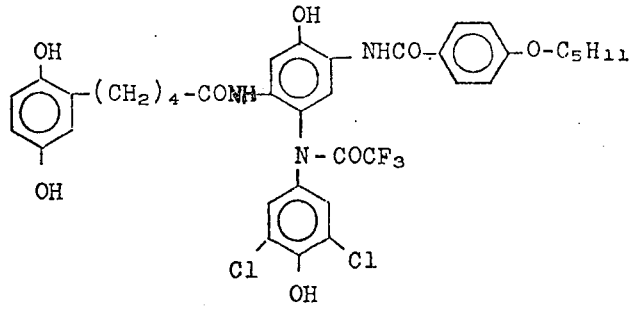

Compound No. 20

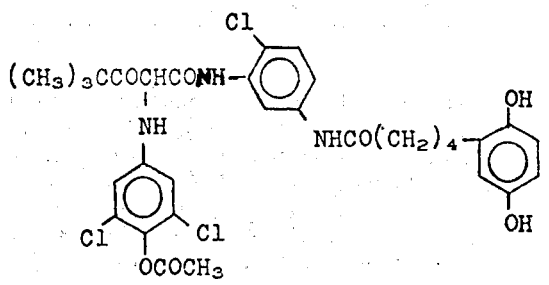

Compound No. 21

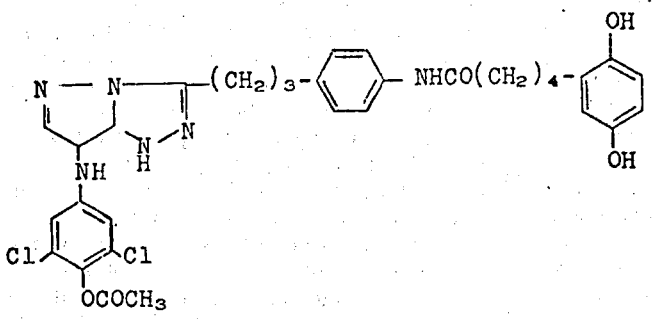

Compound No. 22

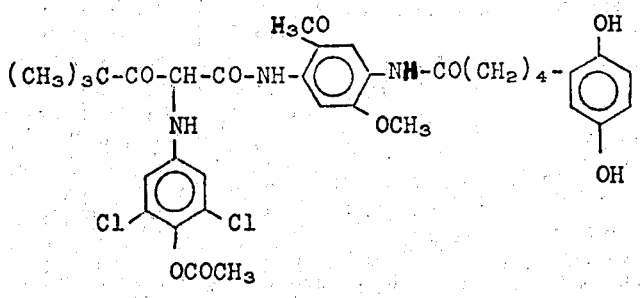

The assemblage of the present invention may be used to produce positive images in single- or multicolors. In a three-color system, each silver halide emulsion layer of the film assembly will have associated therewith a dye image-providing material possessing a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous to the silver halide emulsion layer.

The concentration of the dye image-providing materials that are employed in the present invention may be varied over a wide range depending upon the particular compound employed and the results which are desired. For example, the dye image-providing compounds of the present invention may be coated as dispersions in layers by using coating solutions containing a ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Any silver halide developing agent can be employed in our invention depending upon the particular chemistry system involved. The developer may be employed in the photosensitive element to be activated by the alkaline processing composition. Specific examples of developers which can be employed in our invention include:

hydroquinone
N-methylaminophenol
Phenidone (1-phenyl-3-pyrazolidone)
Dimezone (1-phenyl-4,4-dimethyl-3-pyrazolidone)
aminophenols
N-N-diethyl p-phenylenediamine
3-methyl-N,N-diethyl-p-phenylenediamine N,N,N',N'-tetramethyl-p-phenylenediamine, etc.

In using redox dye releaser compounds in our invention, the production of diffusible dye images is a function of development of the silver halide emulsions with a silver halide developing agent to form either negative or direct positive silver images in the emulsion layers. If the silver halide emulsion employed forms a direct positive silver image, such as a direct positive internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the redox dye releaser compound, the oxidized form of which undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuse to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al. in U.S. Pat. No. 2,592,250 issued Apr. 8, 1952, and elsewhere in the literature. Other useful emulsions are described in U.S. Pat. No. 3,761,276 issued Sept. 25, 1973, U.S. Pat. No. 3,761,266 issued Sept. 25, 1973 and 3,761,267 issued Sept. 25, 1973. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a light-intensity scale having a fixed time between 0.01 and 1 second, and developing for 3 minutes at 20°C in Developer A below ("internal-type" developer) have a maximum density at least five times the maximum density obtained when an equally exposed silver halide emulsion is developed for 4 minutes at 20°C in Developer B described below ("surface-type" developer). Preferably, the maximum density in Developer A is at least 0.5 density unit greater than the maximum density in Developer B.

| DEVELOPER A | |
|---|---|
| Hydroquinone | 15 g. |
| Monomethyl-p-aminophenol sulfate | 15 g. |
| Sodium sulfite (desiccated) | 50 g. |
| Potassium bromide | 10 g. |
| Sodium hydroxide | 25 g. |
| Sodium thiosulfate | 20 g. |
| Water to make one liter. | |

| DEVELOPER B | |
|---|---|
| P-hydroxyphenylglycine | 10 g. |
| Sodium carbonate | 100 g. |
| Water to make one liter | |

The internal-image silver halide emulsions when processed in the presence of fogging or nucleating agents provide direct positive silver images. Such emulsions are particularly useful in the above-described embodiment. Suitable fogging agents include the hydrazines disclosed in Ives U.S. Pat. Nos. 2,588,982 issued Mar. 11, 1952 and 2,563,785 issued Aug. 7, 1951; the hydrazides and hydrazones disclosed in Whitmore U.S. pat. No. 3,227,552 issued Jan. 4, 1966; hydrazone quaternary salts described in British Pat. No. 1,283,835 and U.S. Pat. No. 3,615,615; hydrazone containing polymethine dyes described in U.S. Pat. No. 3,718,470; or mixtures thereof. The quantity of fogging agent employed can be widely varied depending upon the results desired. Generally, the concentration of fogging agent is from about 0.4 to about 8 g per mole of silver in the photosensitive layer in the photosensitive element or from about 0.1 to about 2 grams per liter of developer if it is located in the developer. The fogging agents described in U.S. Pat. Nos. 3,615,615 and 3,718,470, however, are preferably used in concentrations of 0.5 to 10 mg per mole of silver in the photosensitive layer.

The solarizing direct-positive silver halide emulsions useful in the above-described embodiment are well-known silver halide emulsions which have been effectively fogged either chemically or by radiation to a point which corresponds approximately to the maximum density of the reversal curve as shown by Mees, *The Theory of the Photographic Process*, published by the Macmillan Co., New York, New York, 1942, pages 261–297. Typical methods for the preparation of solarizing emulsions are shown by Groves British Pat. No. 443,245, Feb. 25, 1936, who subject emulsions to Roentgen rays "until an emulsion layer formed there from, when developed without preliminary exposure, is blackened up to the apex of its graduation curve"; Szaz British Pat. No. 462,730, Mar. 15, 1937, the use of either light or chemicals such as silver nitrate, organic sulfur compounds and dyes to convert ordinary silver halide emulsions to solarizing direct positive emulsions; and Arens U.S. Pat. 2,005,837, June 25, 1935, the use of silver nitrate and other compounds in conjunction with heat to effect solarization. Particularly useful are the fogged direct-positive emulsions of Berriman U.S. Pat. No. 3,367,778; Illingsworth U.S. Pat. Nos. 3,501,305, 3,501,306 and 3,501,307; and combinations thereof.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181; 2,643,886; 2,653,732; 2,723,051; 3,056,492; 3,056,491; and 3,152,515. In general, such containers comprise a rectangular sheet of fluid-and air-impervious material folded longitudinally upon itself to form two walls which are sealed to one another along their longitudinal and end margins to form a cavity in which processing solution is contained.

In a color photographic-assemblage according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No 2,028,236 or U.S. Pat. Nos. 2,992,104; 3,043,692; 3,044,873; 3,061,428; 3,069,263; 3,069,264; 3,121,011; and 3,427,158.

Generally speaking, except where noted otherwise, the silver halide emulsion layers in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 1 to 7 microns in thickness; and the alkaline solution-permeable polymeric interlayers, e.g., gelatin, are about 1 to 5 microns in thickness. Of course, these thicknesses are approximate only and can be modified according to the product desired.

The alkaline solution-permeable, light-reflective layer employed in certain embodiments of photographic assemblages of our invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix such as, for example, gelatin, polyvinyl alcohol, and the like. Brightening agents such as the stilbenes, coumarins, triazines and oxazoles can also added to the light-reflective layer, if desired. When it is desired to increase the opacifying capacity of the light-reflective layers, dark-colored opacifying agents, e.g., pH-indicator dyes, may be added to it, or carbon black, nigrosine dyes, etc., may be coated in a separate layer adjacent to the light-reflective layer.

Use of a pH-lowering material in the photographic assemblage according to the invention will usually increase the stability of the transferred image. Generally, the pH-lowering material will effect a reduction in the pH of the image layer from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such pH-lowering materials reduce the pH of the film unit after development to terminate development and thus stabilize the dye image. Of course, the use of a scavenger mordant in accordance with our invention will further increase the stability of the transferred image. In certain embodiments of our invention, the scavenger mordant layer may be combined with the polymeric acid layer described above.

An inert timing or spacer layer can be employed in the practice of our invention over the pH-lowering layer and scavenger mordant layer which "times" or controls the pH-reduction and functioning of the scavenger mordant layer as a function of the rate at which alkali diffuses throught the inert spacer layer. Examples of such timing layers include gelatin, polyvinyl alcohol or any of those disclosed in U.S. Pat. No. 3,455,686. The timing layer may also be effective in evening out the various reaction rates over a wide range of temperatures, e.g., premature pH reduction is prevented when imbibition is effected at temperatures above room temperature, for example, at 95° to 100°F. The timing layer is usually about 0.1 to about 0.7 mil in thickness. Especially good results are obtained when the timing layer comprises a hydrolyzable polymer or a mixture of such polymers which are slowly hydrolyzed by the processing composition. Examples of such hydrolyzable polymers include polyvinyl acetate, polyamides, cellulose esters, etc.

As was mentioned above, the scavenger mordant layer employed in our invention is located in the above-described timing layer or behind the timing layer with respect to the silver halide emulsion layer. The timing layer will then delay the functioning of the scavenger layer for a predetermined, finite period of time, e.g., about 20–30 seconds. This will allow development and dye diffusion to the dye image-receiving layer to occur unimpeded. Generally speaking, sufficient image dye will transfer to the dye image-receiving layer to reach a Dmax of about 1 before the scavenger layer becomes operative.

Any material can be employed as the image-receiving layer and the scavenger mordant layer in this invention as long as the desired function of mordanting or otherwise fixing the dye images and by-products of the reaction will be obtained. The particular material chosen will, of course, depend upon the dye to be mordanted. If acid dyes are to be mordanted, the image-receiving layer and scavenger mordant layer can contain basic polymeric mordants such as polymers of amino guanidine derivatives of vinyl methyl ketone such as described in Minsk U.S. Pat. No. 2,882,156 issued Apr. 14, 1959, and basic polymeric mordants such as described in U.S. Pat. Nos. 3,709,690 and 3,625,694 and copending U.S. Applications Ser. No. 400,778 of Cohen et al. filed Sept. 26, 1973 and Ser. No. 412,992 of Burness et al., filed Nov. 5, 1973. Other mordants useful in our invention include poly-4-vinylpyridine, the 2-vinyl pyridine polymer metho-p-toulene sulfonate and similar compounds described in Sprague et al. U.S. Pat. No. 2,484,430 issued Oct. 11, 1949, and cetyl trimethylammonium bromide, etc. Effective mordanting compositions are also described in Whitmore U.S. Pat. No. 3,271,148 and Bush U.S. Pat. NO. 3,271,147, both issued Sept. 6, 1966. Either the same or different mordants can be used in the dye image-receiving layer and the scavenger layer.

Other materials useful in the dye image-receiving layer and scavenger mordant layer include alkaline solution-permeable polymeric layers such as N-methoxymethyl polyhexylmethylene adipamide; partially hydrolyzed polyvinyl acetate; and other materials of a similar nature. Generally, good results are obtained when the image-receiving layer and scavenger mordant layer, preferably alkaline solution-permeable, are transparent and about 0.25 to about 0.40 mil in thickness. This thickness, of course, can be modified depending upon the result desired. The image-receiving layer can also contain ultraviolet absorbing materials to protect the mordanted dye images from fading due to ultraviolet light, brightening agents such as the stilbenes, coumarins, triazines, oxazoles, dye stabilizers such as the chromanols, alkylphenols, etc.

The same types of mordant materials may be used in the dye image-receiving layer and the scavenger mordant layer. While the dye image-receiving layer will generally contain predominantly all of the imagewise transferred dye and is positioned to be viewed against a white, light-reflective background, the scavenger mordant, in accordance with this invention, becomes available after a predetermined time to immobilize the byproducts and unwanted reaction products of the process. The scavenger mordant cannot be seen from the viewing side of the assemblage since it is behind the light-reflective layer and it is usually maintained out of view on the backside of the assemblage by an opaque, non-reflective material, such as a carbon black layer. In certain embodiments of the invention where the processing conditions produce a large amount of unwanted reaction products, a faint image may be discernable on the backside if a transparent support is used. However, the image would not be of sufficient density and have sufficient color separation to be objectionable or provide a useable image record, especially when viewed against an opaque, non-reflective background. For example, in the embodiment illustrated in FIGS. 3 and 4, the timed, scavenger mordant layer is hidden from view on the backside by the opaque support 30. In FIGS. 1 and 2, the alkaline processing composition contains an opaque non-reflective substance such as carbon black, thus any faint image will be, in a practical sense, unnoticable and not objectionable.

Generally, the film assemblages prepared and processed in accordance with our invention contain approximately at least four times as much imagewise transferred dye in the image-receiving layer as compared with the scavenger mordant layer. The large difference in dye transferred to the respective layers is, in part, due to the positioning of the scavenger mordant in or behind a timing layer so that its functioning is controlled to become operative only after a predetermined period of time, as described above, e.g., such as when a transferred dye density of 1.0 has been reached in the Dmax areas of the dye image-receiving layer.

The alkaline processing composition employed in this invention is the conventional aqueous solution of an alkaline material, e.g., sodium hydroxide, sodium carbonate or an amine such as diethylamine, preferably possessing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5% by weight of the processing composition is preferred which will impart thereto a viscosity of about 100 cps. to about 200,000 cps. In certain embodiments of our invention, an opacifying agent, e.g., $TiO_2$, carbon black, indicator dyes, etc., may be added to the processing composition. In addition, ballasted indicator dyes and dye precursors may also be present in the photographic assemblage as a separate layer on the exposure side of the photosensitive layers; the indicator dyes being preferably transparent during exposure and becoming colored or opaque after contact with alkali from the processing composition.

The supports for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-$\alpha$-olefins such as polyethylene and polypropylene film, and related films or resinous materials. The support is usually about 2 to 9 mils in thickness. Ultraviolet absorbing materials may also be included in the supports or as a separate layer on the supports if desired.

The silver halide emulsions useful in our invention are well-known to those skilled in the art and are described in *Product Licensing Index*, Vol. 92, December, 1971, publication 9232, p. 107, paragraph I. "Emulsion types"; they may be chemically and spectrally sensitized as described on p. 107, paragraph III, "Chemical sensitization," and pp. 108–109, paragraph XV, "Spectral sensitization," of the above article; they can be protected against the production of fog and can be stabilized against loss of sensitivity during keeping by employing the materials described on p. 107, paragraph V, "Antifoggants and stabilizers," of the above article; they can contain development modifiers, hardeners, and coating aids as described on pp. 107–108, paragraph IV, "Development modifiers"; paragraph VII, "Hardeners"; and paragraph XII, "Coating aids," of the above article; they and other layers in the photographic elements used in this invention can contain plasticizers, vehicles and filter dyes described on p. 108, paragraph XI, "Plasticizers and lubricants," and paragraph VIII, "Vehicles," and p. 109, paragraph XVI, "Absorbing and filter dyes," of the above article; they and other layers in the photographic elements used in this invention may contain addenda which are incorporated by using the procedures described on p. 109, paragraph XVII, "Methods of addition," of the above article; and they can be coated by using the various techniques described on p. 109, paragraph XVIII, "Coating procedures," of the above article, the disclosures of which are hereby incorporated by reference.

EXAMPLE I

Scavenger Mordant in Polymeric Acid Layer

An integral multicolor photosensitive element is prepared by coating the following layers in the order recited on a transparent cellulose acetate film support:

1. image-receiving layer of copoly[styrene-N-benzyl]-N,N-[dimethyl-N-(3-maleimidopropyl)ammonium chloride](1.08 g/m$^2$) and gelatin (1.08 g/m$^2$);

2. reflecting layer of titanium dioxide (21.76 g/m²) and gelatin (2.18 g/m²);
3. opaque layer of carbon black (2.69 g/m²) and gelatin (1.68 g/m²);
4. Compound I (0.54 g/m²) and gelatin (0.54 g/m²);
5. red-sensitive, internal-image gelatin-silver chlorobromide emulsion (1.08 g gelatin/m² and 1.61 g silver/m²), 2,5-di-sec-dodecylhydroquinone (0.27 g/m²), and nucleating agent formyl-4-methylphenylhydrazine (0.01 g/m²);
6. interlayer of gelatin (1.08 g/m²) and 2-n-octadecyl-5-sulfohydroquinone (0.54 g/m²);
7. Compound II (1.29 g/m²) and gelatin 1.61 g/m²);
8. green-sensitive, internal-image gelatin-silver chlorobromide emulsion (1.08 g gelatin/m² and 1.61 g silver/m²), 2,5-di-sec-dodecylhydroquinone (0.27 g/m²), and nucleating agent formyl-4-methylphenylhydrazine (0.01 g/m²);
9. interlayer of gelatin (0.54 g/m²) and 2-n-octadecyl-5-sulfohydroquinone (0.55 g/m);
*10. green-sensitive, negative-working gelatin-silver bromide emulsion (0.91 g gelatin/m² and 0.43 g silver/m²) and 2,5-di-sec-dodecylhydroquinone (0.89 g/m²);

*The use of a negative-working silver halide emulsion in a photographic element with direct-positive emulsions is described and claimed in our coworkers, Thomas & Tuite, copending Application Ser. No. 291,114, filed Sept. 21, 1972, and as such, forms no part of our invention.

11. interlayer of gelatin (0.54 g/m²) and 2-n-octadecylhydroquinone (0.55 g/m²);
12. Compound III (1.08 g/m²) and gelatin (1.08 g/m²);
13. blue-sensitive, internal-image gelatin emulsion (1.08 g gelatin/m² and 1.61 g silver/m²), 2,5-di-sec-dodecylhydroquinone (0.27 g/m²), and nucleating agent formyl-4-methylphenylhydrazine (0.01 g/m²); and
14. overcoat of gelatin (0.54 g/m²).

An emulsion cover sheet having a polymeric acid and scavenger mordant together in a single layer is prepared by coating on a transparent polyethylene terephthalate film support a copolymer of acrylic acid and 3-methyl-1-vinylimidazolium methosulfate (75/25) at a coverage of 21.5 g/m². The quaternary ammonium salt functions as the scavenger mordant. The element is then overcoated with a timing layer comprising a mixture of 95 parts of cellulose acetate (40% acetyl) and five parts of copolystyrene-maleic anhydride at a coverage of 3.23 g/m².

A similar control element is prepared except that the acid-mordant copolymer is replaced by polyacrylic acid at the same coating coverage.

The following processing composition is employed in processing pods:

| | |
|---|---|
| Hydroxyethyl cellulose | 25.0 g |
| Sodium hydroxide | 60.0 g |
| 4-Hydroxymethyl-4-methyl-1-phenyl-3-pyrazolidone | 8.0 g |
| Potassium iodide | 0.01 g |
| 5-Methylbenzotriazole | 0.8 g |
| tert-butyl hydroquinone | 0.8 g |
| Sodium sulfite | 2.0 |
| Carbon | 40.0 g |
| Distilled water to | 1 liter |

The processing composition is spread between the surface of a portion of the photosensitive element and each of the cover sheets described above by passing the transfer "sandwich" between a pair of juxtaposed pressure rollers having a gap of 0.24 mm. The transfer "sandwich" is then held for 5 minutes at temperatures of 21°C and 38°C, after which time the reflection image density is read. The following results are obtained:

| | Dmax Red | | | Dmax Green | | | Dmax Blue | | |
|---|---|---|---|---|---|---|---|---|---|
| | 21°C | 38°C | Δ | 21°C | 38°C | Δ | 21°C | 38°C | Δ |
| w/o scav. mordant (control) | 1.17 | 2.10 | .93 | 1.35 | 2.08 | .73 | 1.78 | 2.23 | .45 |
| w/scav. mordant | 1.10 | 1.70 | .60 | 1.30 | 1.72 | .42 | 1.60 | 2.06 | .46 |

The results indicate that a scavenger mordant layer employed in accordance with our invention does not significantly change the Dmax obtained at 21° C but reduces the buildup of dye in the image-receiving layer at 38° C.

EXAMPLE II

Scavenger Mordant in Timing Layer

An integral multicolor photosensitive element is prepared as in Example I except that layers 10 and 11 are omitted.

An emulsion cover sheet having the scavenger mordant in the timing layer is prepared by coating on a transparent polyethylene terephthalate film support polyacrylic acid at a coverage of 23.2 g/m². Separate samples of this coating are then overcoated with a timing-scavenger mordant layer of a mixture of 95 parts of cellulose acetate (40% acetyl) and five parts of copolystyrene-maleic anhydride along with the mordant copoly[styrene;(vinylbenzyl)(trihexyl)ammonium chloride] in the amounts listed in the table below. The elements are then processed in the same manner as in example I. The reflection densities of the processed materials are measured fresh and after 1-week and 4-week keeping. The following results are obtained:

| Mordant in Timing Layer | Rm. Keep Time | Dmax R | Dmax G | Dmax B | Dmin R | Dmin G | Dmin B |
|---|---|---|---|---|---|---|---|
| None | Fresh | 1.70 | 1.60 | 1.80 | .35 | .34 | .28 |
| | 1 week | 2.10 | 1.65 | 1.88 | .40 | .34 | .28 |
| | 4 weeks | 2.20 | 1.76 | 1.92 | .42 | .35 | .32 |
| 0.22 g/m² | Fresh | 1.69 | 1.64 | 1.84 | .36 | .34 | .27 |
| | 1 week | 1.88 | 1.64 | 1.87 | .39 | .35 | .30 |
| | 4 weeks | 2.02 | 1.77 | 1.96 | .44 | .36 | .34 |
| 0.43 g/m² | Fresh | 1.81 | 1.72 | 1.77 | .38 | .33 | .26 |
| | 1 week | 1.89 | 1.70 | 1.84 | .40 | .33 | .30 |
| | 4 weeks | 1.97 | 1.73 | 1.88 | .41 | .34 | .30 |
| 0.65 g/m² | Fresh | 1.97 | 1.74 | 1.68 | .40 | .34 | .28 |
| | 1 week | 2.02 | 1.69 | 1.82 | .40 | .30 | .30 |
| | 4 weeks | 2.01 | 1.68 | 1.84 | .40 | .32 | .32 |

From the above table the differences between fresh and four-week keeping are:

| Mordant in Timing Layer | Dmax ΔR | Dmax ΔG | Dmax ΔB | Dmin ΔR | Dmin ΔG | Dmin ΔB |
|---|---|---|---|---|---|---|
| None | +0.50 | +0.16 | +0.12 | +0.07 | +0.01 | +0.06 |
| 0.22 g/m² | +0.33 | +0.13 | +0.12 | +0.08 | +0.02 | +0.07 |
| 0.43 g/m² | +0.16 | +0.01 | +0.11 | +0.03 | +0.01 | +0.04 |
| 0.65 g/m² | +0.14 | −0.04 | +0.14 | 0 | −0.02 | +0.04 |

The above data demonstrates the control in post processing dye density change in the red and green image areas which is realized by employing a scavenger mordant in the timing layer in accordance with our invention.

EXAMPLE III

Scavenger Mordant With Oxichromic Chemistry

A. The image-receiving and reflecting layers of an integral element are prepared by coating the following layers in the order recited on a transparent polyester support:

1. image-receiving layer of poly-4-vinylpyridine (2.15 g/m²) and gelatin (4.3 g/m²);
2. reflecting layer of titanium dioxide (2.15 g/m²) and gelatin (2.15 g/m²); and
3. interlayer of gelatin (1.68 g/m²).

B. A cyan monochrome element is prepared containing gelatin layers to simulate a full multicolor element by coating A) with:

4B. oxichromic developer, Compound 19, (1.07 g/m²) and gelatin (2.15 g/m²); and
5B. gelatin (9.5 g/m²).

C. A magenta monochrome element is prepared containing gelatin layers to simulate a full multicolor element by coating A) with:

4C. gelatin (4.3 g/m²);
5C. oxichromic developer, Compound 20, (1.07 g/m²) and gelatin (2.15 g/m²); and
6C. gelatin (4.7 g/m²).

D. A yellow monochrome element is prepared containing gelatin layers to simulate a full multicolor element by coating A) with:

4D. gelatin (8.6 g/m²);
5D. oxichromic developer, Compound 21, (1.29 g/m²) and gelatin (2.15 g/m²); and
6D. gelatin (0.9 g/m²).

A cover sheet is then prepared by coating a polyethylene coated paper support with a scavenger mordant layer of N-n-octadecyl-tri-butylammonium bromide (2.15 g/m²), dibutyl phthalate (2.15 g/m²) and gelatin (7.55 g/m²). This layer is then overcoated with 0.108 g/m² of gum arabic.

The following alkaline processing composition is employed in a pod:

| | |
|---|---|
| hydroxyethyl cellulose | 25.0 g |
| potassium hydroxide | 40.0 g |
| 1-benzyl-2-picolinium bromide | 5.0 g |
| bis(methylsulfonyl methane) | 1.0 g |
| Water to | 1 liter |

The processing composition is spread between the surface of the elements, (B), (C) and (D) and portions of the cover sheet described above along with a control cover sheet with no mordant layer by passing the transfer "sandwich" between a pair of juxtaposed pressure rollers having a gap of 0.25 mm. The transfer "sandwich" is held for times varying from 0.25 to 8.0 minutes, separated, oxidized for 30 seconds in a 2.0% sodium peroxydisulfate ($Na_2S_2O_8$) solution, washed for 5 minutes and dried. The red, green and blue densities of the respective elements are measured and recorded as follows:

| Transfer Time (minutes) | Blank Cover Sheet | Cover Sheet With Scavenger Mordant | Δ Dmax |
|---|---|---|---|
| Cyan Element | Red Dmax in Dye Image-Receiving Layer | | |
| 0.25 | .78 | .78 | — |
| 0.50 | 1.07 | 1.07 | — |
| 1.0 | 1.38 | 1.38 | — |
| 2.0 | 1.68 | 1.60 | .08 |
| 4.0 | 2.07 | 1.80 | .24 |
| 8.0 | 2.52 | 1.90 | .62 |
| Yellow Element | Blue Dmax in Dye Image-Receiving Layer | | |
| 0.25 | .50 | .45 | .05 |
| 0.50 | .80 | .73 | .07 |
| 1.0 | 1.04 | 1.04 | — |
| 2.0 | 1.37 | 1.37 | — |
| 4.0 | 1.89 | 1.60 | .29 |
| 8.0 | 2.20 | 1.56 | .64 |
| Magenta Element | Green Dmax in Dye Image-Receiving Layer | | |
| 0.25 | .81 | .68 | .13 |
| 0.50 | 1.01 | 1.00 | .01 |
| 1.0 | 1.41 | 1.39 | .02 |
| 2.0 | 1.71 | 1.68 | .03 |
| 4.0 | 2.17 | 1.86 | .31 |
| 8.0 | 2.64 | 1.87 | .71 |

The above data indicate that image density in monochromes which are processed with a cover sheet having a scavenger mordant levels off in 2 minutes transfer time with some loss in overall density but no loss in access time. A scavenger mordant may therefore be used in the cover sheet of an integral color transfer element to reduce excessive dye production in the dye image-receiving layer without slowing down image access time.

EXAMPLE IV

An integral photosensitive element containing gelatin layers to simulate a full multicolor element is prepared by coating the following layers in the order recited on a transparent polyester support:

1. image-receiving layer of copoly[styrene(N,N-diethyl-N-benzyl-N-3-maleimidopropyl)ammonium]chloride (4.3 g/m²) and gelatin (1.07 g/m²);
2. reflecting layer of titanium dioxide (21.5 g/m²) and gelatin (2.15 g/m²);
3. interlayer of gelatin (3.82 g/m²); and
4. gelatin-silver bromoiodide (2 mole % $I^-$) emulsion (3.82 g gelatin/m² and 1.29 g silver/m²), oxichromic developer, Compound 22, (1.29 g/m²) and 4′-methylphenylhydroquinone (0.18 g/m²).

This element is processed as in example III, the photosensitive element being unexposed, utilizing a blank cover sheet and a cover sheet containing a scavenger mordant as in Example III. The following data is obtained:

| Transfer Time (minutes) | Blue Dmax in Dye Image-Receiving Layer: Blank Cover Sheet | Cover Sheet With Scavenger Mordant | Δ Dmax |
|---|---|---|---|
| 0.25 | 0.90 | 0.75 | .15 |
| 0.50 | 1.05 | 1.10 | −.05 |
| 1.0 | 1.60 | 1.65 | −.05 |
| 2.0 | 2.09 | 2.04 | .05 |
| 4.0 | 2.65 | 2.17 | .48 |
| 8.0 | 2.60 | 2.30 | .30 |

This data demonstrates the use of a scavenger mordant to reduce unwanted dye production in the dye image-receiving layer of an integral, color transfer assemblage.

The invention has been described with particular reference to certain preferred embodiments thereof, but it will be understood that variations and modifications can be effected within the spirit and scope of the invention.

We claim:

1. In a photographic assemblage comprising:

a. a support having thereon at least one photosensitive silver halide emulsion layer, said emulsion layer having associated therewith a dye image-providing material;

b. a dye image-receiving layer; and c. means for discharging an alkaline processing composition within said assemblage;

said assemblage containing a silver halide developing agent, the improvement comprising employing a scavenger mordant layer in said assemblage to scavenge excess dye and unwanted byproducts produced during processing of said assemblage, said scavenger mordant layer being so located in said assemblage that when said alkaline processing composition is discharged within said assemblage to form a layer, the scavenger mordant layer will be on one side of both said alkaline processing composition layer and said emulsion layer and the dye image-receiving layer will be on the other side of said layers, and wherein said scavenger mordant layer is located in a timing layer or behind a timing layer with respect to said silver halide emulsion layer and said alkaline processing composition layer so that at least approximately four times as much dye will be imagewise transferred after processing to said dye image-receiving layer as compared with said scavenger mordant layer.

2. The assemblage of claim 1 wherein:

a. said dye image-receiving layer is located betweem said support and said silver halide emulsion layer; and b. said assemblage also includes a transparent sheet superposed over the layer outermost from said support.

3. The assemblage of claim 2 wherein said scavenger mordant layer and its associated timing layer are on said transparent sheet.

4. The assemblage of claim 3 wherein said transparent sheet includes a pH-lowering layer.

5. The assemblage of claim 4 wherein said pH-lowering layer is a polymeric acid.

6. The assemblage of claim 5 wherein said transparent sheet comprises a transparent support coated with said polymeric acid layer, said scavenger mordant layer, and said timing layer.

7. The assemblage of claim 2 wherein said discharging means is a rupturable container containing said alkaline processing composition and an opacifying agent, said container being so positioned during processing of said assemblage that a compressive force applied to said container will effect a discharge of the container's contents between said transparent sheet and the outermost layer of said photosensitive element.

8. The assemblage of claim 1 comprising:

a. a photosensitive element comprising a transparent support having thereon the following layers in sequence: an image-receiving layer, an alkaline solution-permeable, light-reflective layer, an alkaline solution-permeable, opaque layer, a nondiffusible redox cyan dye releaser layer, a red-sensitive silver halide emulsion layer, a non-diffusible redox magenta dye releaser layer, a green-sensitive silver halide emulsion layer, a nondiffusible redox yellow dye releaser layer, and a blue-sensitive silver halide emulsion layer;

b. a transparent sheet superposed over said blue-sensitive silver halide emulsion layer and comprising a transparent support coated with a polymeric acid layer, said scavenger mordant layer, and said timing layer; and c. a rupturable container containing said alkaline processing composition and an opacifying agent, said container being so positioned during processing of said assemblage that a compressive force applied to said container will effect a discharge of the container's contents between said timing layer on said transparent sheet and said blue-sensitive silver halide emulsion layer.

9. The assemblage of claim 8 wherein each said redox dye releaser is a nondiffusible sulfonamido compound which is alkali-cleavable upon oxidation to release a diffusible color-providing moiety from the benzene nucleus, said compound having the formula:

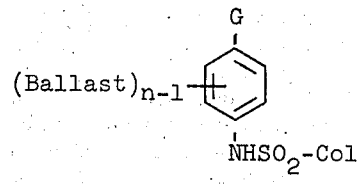

wherein:

1. Col is a dye or dye precursor moiety;
2. Ballast is an organic ballasting radical of such molecular size and configuration as to render said compound non-diffusible during development in an alkaline processing composition;
3. G is OR or $NHR_1$ wherein R is hydrogen or a hydrolyzable moiety and $R_1$ is hydrogen or an alkyl group of 1 to 22 carbon atoms; and
4. *n* is a positive integer of 1 to 2 and is 2 when G is OR or when $R_1$ is hydrogen or an alkyl group of less than 8 carbon atoms.

10. The assemblage of claim 9 wherein each said silver halide emulsion layer is a direct positive silver halide emulsion.

11. The assemblage of claim 1 wherein the same material is used for said dye image-receiving layer and said scavenger mordant layer.

12. The assemblage of claim 1 wherein different materials are used for said dye image-receiving layer and said scavenger mordant layer.

13. The assemblage of claim 1 wherein said dye image-receiving layer is located on a separate transparent support superposed over the layer outermost from an opaque support having thereon said photosensitive silver halide emulsion layer.

14. The assemblage of claim 13 wherein said scavenger mordant layer and its associated timing layer are located between said opaque support and said silver halide emulsion layer.

15. The assemblage of claim 14 wherein the material in said scavenger mordant layer and the material in said timing layer are present together in a single, timed scavenger layer.

16. The assemblage of claim 13 which includes a pH-lowering layer between said transparent support and said dye image-receiving layer.

17. The assemblage of claim 16 wherein said pH-lowering layer is a polymeric acid layer.

18. The assemblage of claim 17 wherein said transparent support is coated with said polymeric acid layer, a timing layer, and said dye image-receiving layer.

19. The assemblage of claim 13 wherein said discharging means is a rupturable container containing said alkaline processing composition and an opacifying agent, said container being so positioned during processing of said assemblage that a compressive force applied to said container will effect a discharge of the container's contents between said transparent sheet and the outermost layer of said photosensitive element.

20. The assemblage of claim 19 wherein said opacifying agent is an inorganic light-reflecting pigment and said processing composition also contains a dye which absorbs light within the visible region at the pH of said alkaline composition, said dye exhibiting light absorption substantially outside of the visible region at a second pH which is lower than said first-mentioned pH.

21. The assemblage of claim 20 wherein said dye is a phthalein dye.

22. The assemblage of claim 20 wherein said light-reflecting pigment is titanium dioxide.

23. The assemblage of claim 13 comprising:

a. a photosensitive element comprising an opaque support having thereon the following layers in sequence: said scavenger mordant layer, said timing layer, a cyan dye image-providing material, a red-sensitive silver halide emulsion layer, a magneta dye image-providing material, a green-sensitive silver halide emulsion layer, a yellow dye image-providing material and a blue-sensitive silver halide emulsion layer;

b. a transparent sheet superposed over said blue-sensitive silver halide emulsion layer and comprising a transparent support coated with a polymeric acid layer, a timing layer, and said dye image-receiving layer; and c. a rupturable container containing said alkaline processing composition and an opacifying agent, said container being so positioned during processing of said assemblage that a compressive force applied to said container will effect a discharge of the container's contents between said dye image-receiving layers on said transparent sheet and said blue-sensitive silver halide emulsion layer.

24. The assemblage of claim 23 wherein each said dye image-providing material is a redox dye releaser.

25. The assemblage of claim 24 wherein each said redox dye releaser is a nondiffusible sulfonamido compound which is alkali-cleavable upon oxidation to release a diffusible color-providing moiety from the benzene nucleus, said compound having the formula:

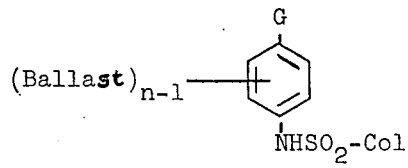

wherein:

1. Col is a dye or dye precursor moiety;
2. Ballast is an organic ballasting radical of such molecular size and configuration as to render said compound nondiffusible during development in an alkaline processing composition;
3. G is OR or $NHR_1$ wherein R is hydrogen or a hydrolyzable moiety and $R_1$ is hydrogen or an alkyl group of 1 to 22 carbon atoms; and
4. *n* is a positive integer of 1 to 2 and is 2 when G is OR or when $R_1$ is hydrogen or an alkyl group of less than 8 carbon atoms.

26. The assemblage of claim 25 wherein each said silver halide emulsion layer is a direct positive silver halide emulsion.

27. The assemblage of claim 13 wherein said dye image-providing material is a dye developer.

28. The assemblage of claim 13 wherein said dye image-providing material is an oxichromic compound which contains a reduced azomethine linkage.

* * * * *